US005460843A

United States Patent [19]

Greene

[11] Patent Number: 5,460,843

[45] Date of Patent: Oct. 24, 1995

[54] METHOD AND APPARATUS FOR INVERTING SELECTED COOKIES FROM A SERIES OF MOVING COOKIES

[75] Inventor: William F. Greene, Athens, Ga.

[73] Assignee: Food Machinery Sales, Inc., Athens, Ga.

[21] Appl. No.: 999,357

[22] Filed: Dec. 31, 1992

[51] Int. Cl.[6] ..... B65B 23/14

[52] U.S. Cl. ..... 426/392; 426/121

[58] Field of Search ..... 99/450.4, 450.5, 99/450.7; 426/392, 121

[56] References Cited

U.S. PATENT DOCUMENTS

| | | | |
|---|---|---|---|
| 2,141,883 | 12/1938 | Simmons | 198/156 |
| 2,575,847 | 11/1951 | Skillman | 198/40 |
| 2,707,924 | 5/1955 | Hansen | 107/12 |
| 2,831,564 | 4/1958 | Pavesi | 198/30 |
| 3,371,595 | 3/1968 | Peters | 99/352 |
| 3,410,198 | 11/1968 | Lohr et al. | 99/432 |
| 3,993,788 | 11/1976 | Longenecker | 426/243 |
| 4,043,259 | 8/1977 | Sato | 99/353 |
| 4,194,443 | 8/1975 | Mims | 99/450.4 |
| 4,384,813 | 5/1983 | Smith et al. | 414/31 |
| 4,583,451 | 4/1986 | Kanagy | 99/423 |
| 4,715,272 | 12/1987 | Mendoza | 99/339 |
| 5,095,684 | 3/1992 | Walker et al. | 55/443 |

*Primary Examiner*—Frank Spear
*Attorney, Agent, or Firm*—Hopkins & Thomas

[57] ABSTRACT

A cookie flipping apparatus (23) for conveying a series of cookies (31,33) along a processing path from an upper level surface conveyor (51) to a main lower level surface conveyor (24), and for inverting, or flipping, selected cookies of the series with a flip plate (54) as they drop from the upper level surface conveyor to the lower level surface conveyor, so that a predetermined quantity of cookies can be packaged in an edge-standing upright stacked relationship with the top surface of the endmost cookies facing outwardly from the quantity of cookies.

29 Claims, 3 Drawing Sheets

METHOD AND APPARATUS FOR INVERTING SELECTED COOKIES FROM A SERIES OF MOVING COOKIES

FIELD OF THE INVENTION

This invention pertains a system for packaging cookies, crackers, biscuits, and other products of similar shapes as the products move in series toward a loading station wherein the products are loaded into trays and subsequently packaged for shipment to market. More specifically, this invention pertains to a method and apparatus for inverting selected cookies of a series of moving cookies as the cookies are carried by a conveyor system so that the inverted cookie and a number of adjacent non-inverted cookies can be formed into a slug of edge-standing cookies and packaged with the end cookies of the slug facing outwardly in the packaging.

BACKGROUND OF THE INVENTION

In large scale production and packaging of cookies, crackers, and other similar food items, it is desirable to arrange the cookies in an orderly manner and package them in a transparent material so that the cookies are visible from outside the package and are attractively presented for sale. To accomplish this, the cookies are packaged oftentimes in transparent cookie trays in a vertically aligned edge-standing arrangement in the trays to form a row or "slug" of edge-standing cookies. A single package of cookies typically contains several of these "slugs" of edge-standing cookies with the slugs aligned adjacent each other in an orderly arrangement.

Each slug of cookies has a first and last cookie at the ends of the slug, which end cookies are usually visible when transparent packaging is used. Because the tops or faces of the single layer cookies, as opposed to multiple layer sandwich crackers, usually are more decorative and appealing than the undersides of the cookies, it is desirable that the first and the last cookie of each slug of cookies be arranged facing outwardly at the end of the slug such that the face or the top surface of the cookies is exposed through the transparent wrapping. So arranged, consumer's can see the decorative tops of the cookies when they view or handle the package. Having the end cookies facing outwardly is especially desirable when the transparent portion of the wrappings is only around the sides of the package such that the tops of the end cookies are the most visible portions of the cookies.

In prior art methods for arranging cookies in cookie trays with the end cookies facing outwardly, an operator flips one of the end cookies by hand either after the slug has been formed or while the cookies move through a processing line. Such a manual process increases packaging costs.

Accordingly, a heretofore unaddressed need exists for an improved method and apparatus for automatically flipping or inverting the end cookie in a slug of cookies prior to loading the slug of cookies into a cookie tray.

SUMMARY OF THE INVENTION

Briefly described, the present invention comprises a method and apparatus for flipping one of the end cookies of a series of cookies prior to forming the series of cookies into a slug of cookies as the cookies advance in series along a conveyor path from the baking ovens to the loading station of the packaging line.

The present invention operates in conjunction with a cookie loading apparatus that receives the cookies from the conveyor belts of the present invention and stacks the cookies in an edge-standing configuration for loading into a cookie tray. While the present invention is discussed with reference to cookies, it should by understood that the present invention can also be used in the packaging of other similarly shaped objects.

The cookie flipping apparatus comprises an upper level cookie infeed surface conveyor and a main lower level cookie delivery surface conveyor wherein the end of the upper level surface conveyor is positioned above and partially over the beginning of the lower level surface conveyor. The cookies advance along the upper level surface conveyor in an as baked attitude with their tops facing upwardly, and then fall off the end of the upper level surface conveyor and onto the lower level surface conveyor for delivery to the cookie loading apparatus. An example of such a cookie loading apparatus is disclosed in U.S. Pat. No. 4,736,570 of Hardage, et al., which is incorporated herein by reference.

A flip plate is provided between the upper lever surface conveyor and the lower level surface conveyor. The flip plate reciprocates horizontally from beneath the upper level surface conveyor outwardly beyond the trailing end thereof and above the beginning end of the lower level surface conveyor. The flip plate has a lip at its forward edge for catching the cookies as they fall from the upper level conveyor and flipping them as they fall onto the lower level surface conveyor. Upstream on the upper level surface conveyor, the cookies are spaced substantially equi-distance from one another, and the flip plate is controlled by a drive mechanism that advances the flip plate in timed relationship with the position of the cookies on the upper conveyor.

In operation, the cookies move along the upper level surface conveyor in series spaced equidistance in an as-baked attitude toward the end of the upper level surface conveyor. From the end of the upper level surface conveyor, the cookies normally drop onto the lower level surface conveyor without flipping over. Thus, the cookies fall onto the lower level surface conveyor in an as-baked attitude with their tops or faces still positioned upwardly.

When a predetermined number of cookies have dropped to the lower level surface conveyor, which number for example may be every ninth cookie, the flip plate moves outwardly from beneath the upper surface conveyor. The movement of the flip plate is controlled in timed relationship with position of the cookies along the upper level surface conveyor. As the end cookie to be flipped moves off the end of the upper level surface conveyor, the leading edge of the end cookie engages the lip on the flip plate. At this point, the flip plate retracts backwardly beneath the upper level surface conveyor. As the lip on the flip plate pulls the leading edge of the end cookie backwardly, the trailing portion of the end cookie moves or "flips" over the leading edge as the end cookie falls onto the lower level surface conveyor.

With the end cookies of each slug arranged in an inverted attitude along the lower level surface conveyor, the cookies of each slug can be shingle stacked and loaded into cookie trays at the loading apparatus with the first cookie and the last cookie of each slug of cookies both facing outwardly from the cookie tray.

Accordingly, it is an object of the present invention to provide a method and apparatus for automatically flipping or inverting selected cookies from a series of cookies as they are advanced along a processing path from the baking ovens to the loading stations of a packaging machine.

Another object of the present invention is to provide a method and apparatus for flipping cookies as they are moved from an upper level surface conveyor to a lower level surface conveyor, so that a series of cookies with selected cookies inverted move along the lower level surface conveyor toward the loading station.

Another object of the present invention is to provide a method and apparatus for catching the leading edge of a cookie as it falls from an upper level surface conveyor to a lower level surface conveyor to cause the trailing edge of the cookie to overturn the leading edge and thus cause the cookie to flip as it falls onto the lower level surface conveyor.

Another object of the present invention is to provide a method and apparatus for flipping cookies as the cookies move in spaced series along surface conveyor means, that is simple in design and operates efficiently to flip the cookies in an orderly arrangement without damaging them.

These and other objects, features, and advantages will become apparent from the following detailed description when read in conjunction with the accompanying drawings.

DETAILED DESCRIPTION

Figure 1:
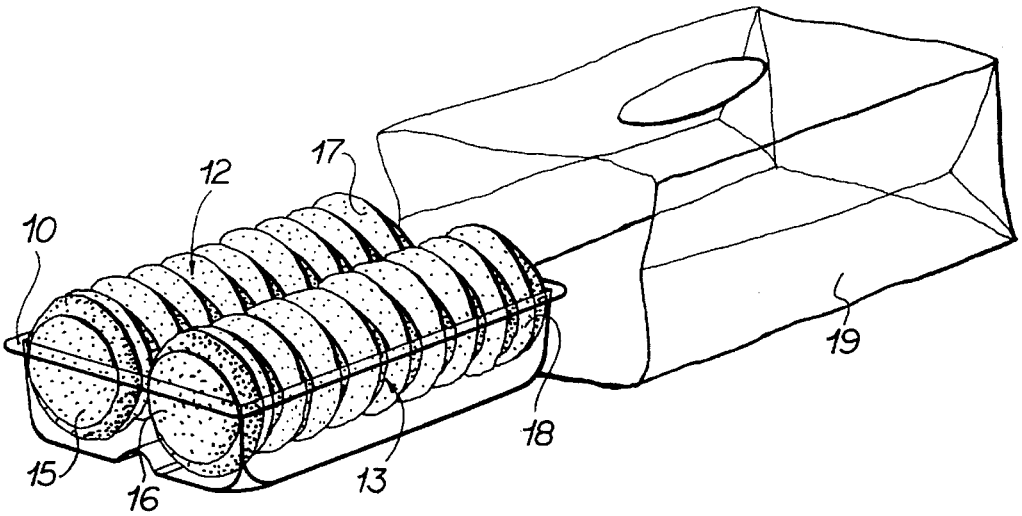
FIG. 1 is a perspective view of a cookie tray loaded with two slugs of cookies prior to being packaged.

Referring now in more detail to the drawings, in which like numerals represent like parts throughout the several views, FIG. 1 is a perspective view of a cookie tray 10 in which two groups or slugs of cookies 12 and 13 are loaded. The cookie tray 10 is shown made of a transparent material so that the cookies loaded therein are clearly visible through the tray. The front cookies 15,16 and the back cookies 17,18 of each slug of cookies 12, 13 are positioned within the cookie tray with their top surfaces or faces pointing outwardly of the cookie tray and away from the slug of cookies. This arrangement exposes the usually more decorative top surfaces or faces of the cookies at both ends of the cookie tray so that when the cookie tray is packaged in a transparent wrapping 19, the top surfaces of the end cookies of each slug are attractively presented for viewing by consumers.

Figure 2:
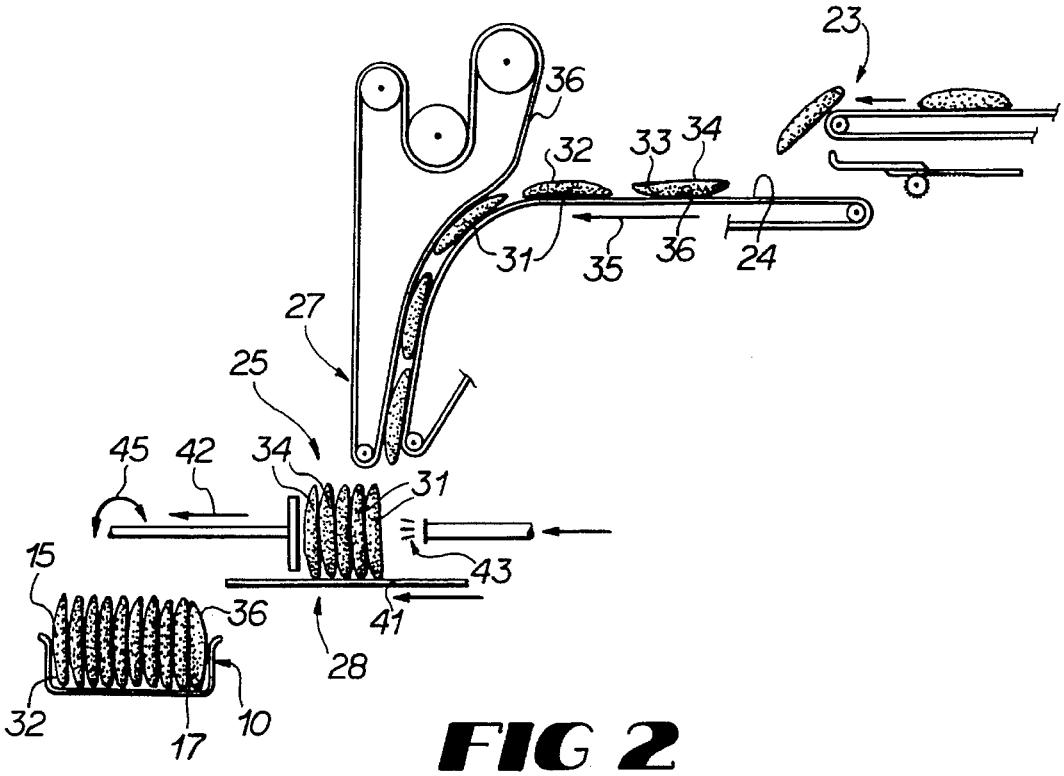
FIG. 2 is a schematic view of the cookie packaging system for loading cookies into cookie trays in the manner illustrated in FIG. 1.

FIG. 2 illustrates a cookie loading system comprising, generally, the cookie flipping apparatus 23 of the present invention including a main cookie delivery surface conveyor 24, and a cookie loading apparatus 25. The cookie loading apparatus 25 includes generally an overhead belt system 27 and a cookie receptacle 28. Below the cookie receptacle is positioned the cookie tray 10, which is carried by a separate conveyor (not shown). The cookie flipping apparatus 23 delivers a series of cookies 31 in an as baked attitude with their top surfaces or faces 32 facing upwardly and a selected cookie 33, which may for example be every tenth cookie, in a flipped or inverted attitude with its top surface 36 against the conveyor and its bottom surface 34 facing upwardly. As the cookies 31,33 move in the direction indicated by arrow 35, they reach the delivery end of the main surface conveyor 24 which moves in a downward arc so as to change the attitude of the cookies from a horizontal or "as baked" attitude to a vertical or "edge standing" attitude for loading into the cookie receptacle 28. The overhead conveyor belt system 27 and the cookie receptacle apparatus 28 are described in more detail in U.S. Pat. No. 4,736,570 to Hardage, et al., which is incorporated herein by reference.

The overhead conveyor belt system 27 functions to stabilize the cookies as they move through the downward arc at the delivery end of the main surface conveyor 24. The overhead belt system 27 includes an overhead belt 36 that moves into overlying relationship with the opposite side portions of the main surface conveyor 24 and lightly presses against the cookies 31,33 as they move downwardly through the delivery end of the main surface conveyor 24, so as to control the movements of the cookies as they are discharged from the conveyor belt.

The cookie receptacle 28 is located beneath the main surface conveyor 24 and overhead conveyor belt 27 and is positioned to receive the cookies 31,33 as they are discharged from the belts. The cookie receptacle 28 includes an elongated trough 41, which is wide enough to receive the cookies in a horizontal, edge standing stack. The elongated trough 41 moves in increments, as indicated by arrow 42, as the cookies 31,33 are discharged from the conveyor belts so that a space is made in the receptacle as each on coming cookie is received therein.

As the cookies 31 are stacked in the elongated trough 41, the top surfaces or faces 32 of the cookies 31 are facing forwardly, or to the left as shown in FIG. 2. In addition, a stream of air, as indicated at 43, is directed along the length of the elongated trough 41 so as to urge the current last cookie received in the receptacle to remain in its upright or edge standing attitude and to be lightly biased toward the previously received cookie. The stream of air assures that each cookie remains in its edge standing attitude and does not tip over and fall into the space for the next oncoming cookie. When the flipped cookie 33 moves between the conveyor belts and is discharged into the cookie receptacle 28, its top surface 36 is facing rearwardly, or to the right as shown in FIG. 2.

When the cookie receptacle has received the predetermined number of cookies therein, including the flipped cookie 33, the cookie receptacle 28 is rotated, as indicated by arrow 45, to become inverted momentarily, and to dump the slug of cookies into the cookie tray 10 immediately below the receptacle. As loaded in the cookie tray, the end cookies 15,17 of the slug are oriented so that their top surfaces 32,36 face outwardly of the tray. So arranged, the cookie tray can be packaged in transparent wrapping with the cookies attractively arranged therein.

Figures 3, 4:
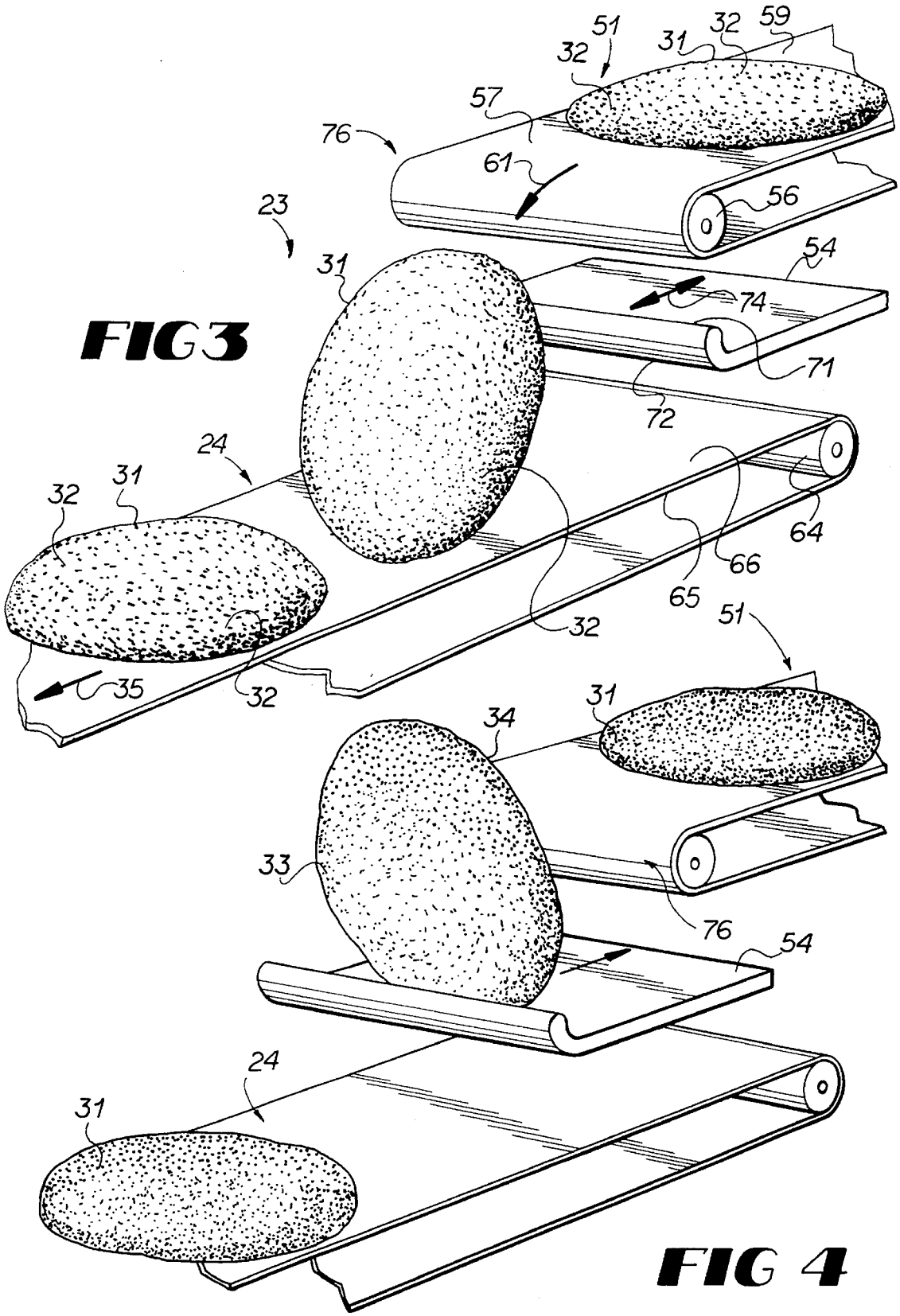
FIG. 3 is a fragmentary perspective view of the cookie flipping apparatus of the present invention.
FIG. 4 is a fragmentary perspective view of the cookie flipping apparatus of FIG. 3 shown with the cookie flipping mechanism flipping a cookie.

FIG. 3 is a fragmentary perspective view of the cookie flipping apparatus 23 constructed in accordance with a preferred embodiment of the present invention. The cookie flipping apparatus 23 comprises an upper level cookie delivery surface conveyor 51, the main lower level cookie delivery surface conveyor 24, and a cookie flipping member, or a flip plate 54. The upper level surface conveyor 51 includes a roller 56 and a conveyor belt 57 that is driven to convey the cookies 31 along the upper surface 59 of the upper level surface conveyor 51 in the direction indicated by arrow 61.

The main lower level surface conveyor 24 likewise includes a roller 64 and a conveyor belt 65 including an upper conveying surface 66. The main lower level surface conveyor 24 is driven by a source (not shown) and conveys the cookies 31 in the direction indicated by arrow 35 toward the cookie loading apparatus.

The flip plate 54 is a generally rectangularly shaped plate that includes a lip or rim 71 that extends upwardly from the leading edge 72 of the flip plate. The flip plate 54 moves in a reciprocating fashion, as indicated by arrow 74 from beneath the upper level surface conveyor 51 outwardly beyond the end 76 thereof and back underneath the upper level surface conveyor. The flip plate 54 can be driven by any number of conventional drive mechanisms known in the art, such as a rack and pinion arrangement, discussed later.

In operation, the cookies 31 are advanced along the upper surface 59 of the upper level surface conveyor 51 in the direction indicated by arrow 61 off the end 76 of the upper level surface conveyor 51, where the cookies drop down onto the upper surface 66 of the main lower level surface conveyor 24. The cookies move along both the upper level surface conveyor and the main lower level surface conveyor in an as baked attitude with the top surfaces 32 or faces of the cookies facing upwardly. The spacing of the cookies 31 along the upper level surface conveyor is achieved by a cookie spacer mechanism, discussed later.

The distance that the upper level surface conveyor is positioned above the main lower level surface conveyor is dictated by the diameter of the cookies. The smaller the diameter, the closer the two conveyors should be positioned in relationship to one another so that as the cookies drop off of the upper level surface conveyor, they fall onto the main lower level surface conveyor without flipping over. In a preferred embodiment, the distance between the conveyors is approximately one-half the diameter of the cookies.

FIG. 4 is a perspective view of an end cookie 33 being flipped over by the flip plate 54. After a selected number of cookies have dropped from the upper level surface conveyor 51 onto the main lower level surface conveyor 24, the flip plate 54 is reciprocated outwardly beyond the end 76 of the upper level surface conveyor 51 to flip the cookie 33 over so that it drops onto the main lower level surface conveyor 24 with its underside 34 facing upwardly. The movement of the flip plate is controlled in timed relationship to the position of the cookies along the upper level surface conveyor by either a cookie sensor means or a cookie spacer mechanism, each discussed later. Thus, as the cookies are advanced along the main lower level surface conveyor, a series of upright facing cookies are followed by a single inverted or flipped cookie, which set of cookies are subsequently stacked in an upright configuration to form a slug of cookies with the two end cookies of the slug having their top surfaces facing outwardly from the slug of cookies. However, in the alternative, the cookies could be advanced by the upper and lower level surface conveyors in an up-side-down, already flipped, attitude with their tops or faces pointing downwardly, and wherein selected cookies are flipped right side up. With such an arrangement, the cookie receptacle 28 of FIG. 2 would be indexed in the opposite direction to arrow 42.

Figure 5:
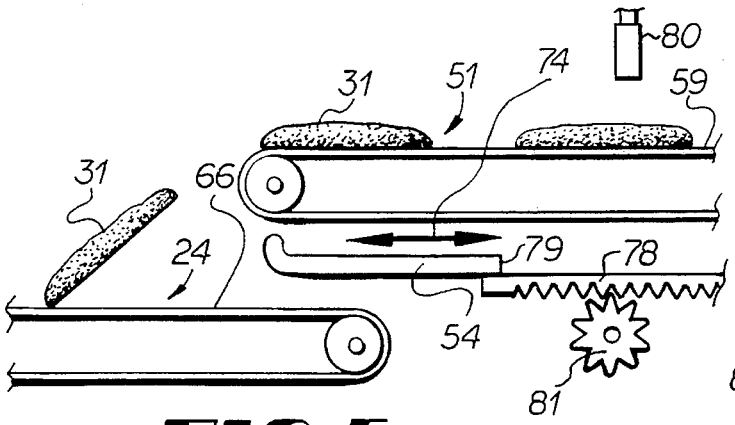
FIGS. 5–8 are side views of the cookie flipping apparatus of FIG. 3 illustrating a flipping sequence for a cookie.

FIG. 5 illustrates the reciprocating mechanism for driving the flip plate 54. The drive mechanism includes a rack 78 mounted at the inner end 79 of the flip plate 54 and a pinion 81 for driving the rack 78 in a reciprocating manner, as indicated by arrow 74. The pinion is rotated by a conventional motor well known in the art. In FIG. 5, a cookie 31 is illustrated dropping from the upper level surface conveyor 51 onto the main lower level surface conveyor 24 with the flip plate 54 retracted. The cookie 31 drops onto the main lower level surface conveyor without flipping due to the relationship between the diameter of the cookie and the distance between the upper surface 59 of the upper level surface conveyor 51 and the upper surface 66 of the main lower level surface conveyor 24.

A cookie sensor means 80 is positioned above the upper level surface conveyor 51. The cookie sensor means 80, which may consist of a photocell, detects the passage of the cookies below it along the upper level surface. A cookie counter mechanism (not shown) operates in conjunction with the sensor means 80 to determine when the selected cookie to be flipped has passed the sensor means. The flip plate is controlled in response to the sensor means and the counter mechanism.

Figure 6:
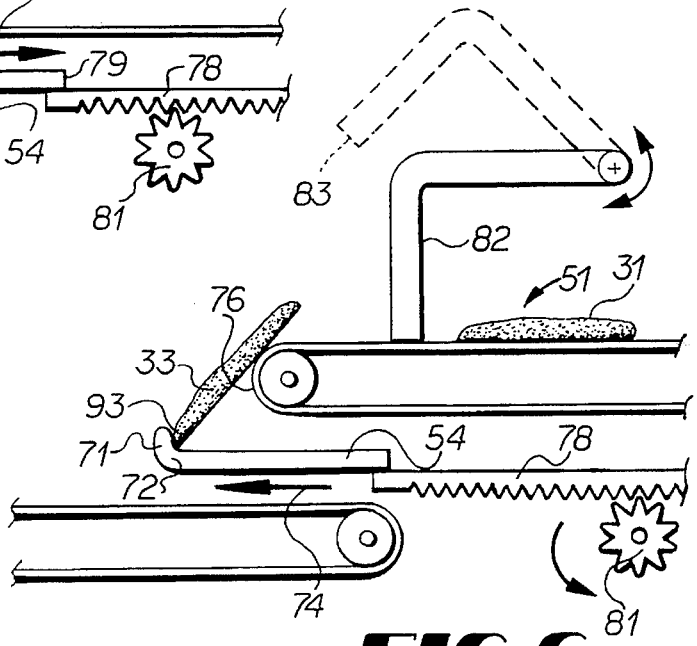

However, an alternative method for controlling the timed relationship between the flip plate and the position of the cookies is illustrated in FIG. 6. A cookie spacer mechanism 82, comprising a pair of L-shaped fingers, is provided along the upper level surface conveyor upstream of the flip plate 54. The cookie spacer mechanism 82 is recipricable between an up position, shown in dashed lines, wherein the distal ends 83 of its fingers are above the cookies 31, and a down position, shown in solid lines. In its down position, the distal ends 83 of the cookie spacer mechanism 82 are adjacent the upper level surface conveyor 51. In this position, a cookie 31 engages the spacer mechanism 82 and the movement of the cookie is halted until the cookie flipper mechanism 82 reciprocates upwardly out of the way of the cookies. The purpose of the cookie spacer mechanism 82 is to position the cookies 31 along the upper level surface conveyor 51 in a predetermined spaced relationship so that the flip plate 54 can be reciprocated intermittently at a predetermined rate based on the speed of the upper level surface conveyor.

Figure 7:
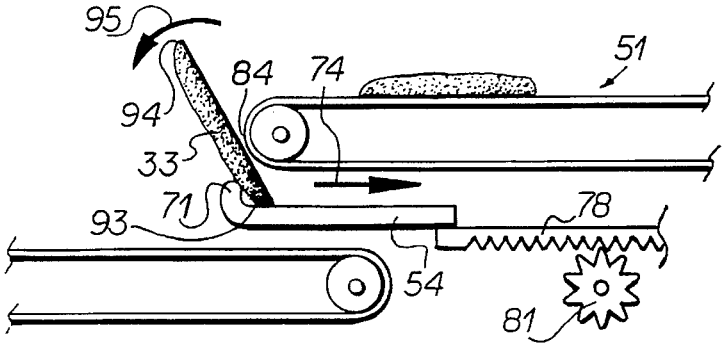
Figure 8:
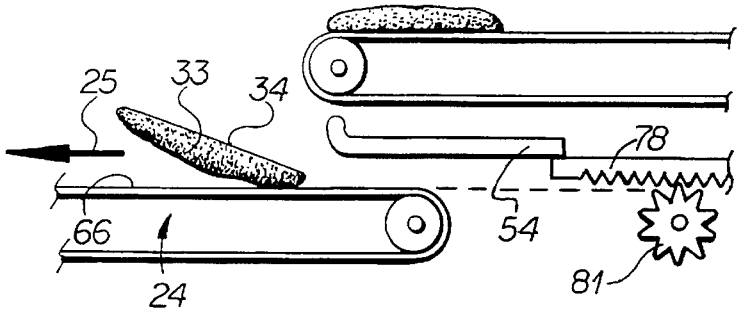

FIGS. 6–8 illustrate the sequence of steps for inverting or flipping a cookie. FIG. 6 illustrates an end cookie 33 falling off the end 76 of the upper level surface conveyor 51 with the flip plate 54 extended outwardly from beneath the upper level surface conveyor 51, as indicated by arrow 74. The rim or lip 71 at the leading edge 72 of the flip plate 54 engages the leading edge 93 of the cookie 33.

As shown in FIG. 7, the flip plate 54 is retracted rearwardly underneath the upper level surface conveyor 51 with the lip 71 of the flip plate urging the leading end 93 of the cookie 33 rearwardly, as indicated by arrow 74. This causes the underside of the cookie 33 to engage the side 84 of the upper level surface conveyor 51. The opposite forces exerted on the cookie by the flip plate 54 and the side 84 of the upper level surface conveyor 51 causes the trailing edge 94 of the cookie 33 to overturn the leading edge 93, as indicated by arrow 95, thus causing the cookie to flip. Thus, it can be seen that the side 84 of the upper level surface conveyor 51 functions as a cookie bottom surface engaging means that operates in conjunction with the flip plate 54 to flip the cookies.

FIG. 8 illustrates the cookie 33 releasing from the flip plate 54 and falling onto the upper surface 66 of the main lower level surface conveyor 24 in an inverted or flipped attitude. The underside 34 of the cookie is facing upwardly as the cookie 33 is advanced along the main lower level surface conveyor, as indicated by arrow 25.

In the large scale production and packaging of cookies, a cookie processing line ideally would employ several lines of cookies with each column of cookies advancing along their own processing path from an upper level surface conveyor to a main lower level surface conveyor. A common elongated flip plate would be actuated to flip a cookie from each line of cookies at the same time. As is understood by those skilled in the art, a common drive mechanism can be used to drive all of the upper level surface conveyors, the lower level surface conveyors, and the flip plate. In addition, the cookie loading apparatus would employ several overhead conveyor belts and cookie receptacles, one for each line of cookies.

Thus, it can be seen that a simple and efficient means is now provided for automatically flipping selected cookies from a series of cookies as they are advanced along a processing path in a cookie packaging operation. It should also be commonly understood that the cookie flipping apparatus disclosed herein is equally applicable for use with other similarly shaped baked food items, such as crackers, biscuits, or wafer-like items, as well as any other solid objects that are generally flat in shape.

The features and principles of a preferred embodiment of the present invention have been illustrated in the foregoing description; however, it will be apparent to those skilled in the art that changes or modification may be made thereto without departure from the spirit and scope of the invention.

I claim:

1. A method of automatically overturning selected cookies or the like, comprising the steps of:

moving the cookies in series along an upper level surface conveyor;

releasing the cookies from the upper level surface conveyor to allow the cookies to drop toward a lower level surface conveyor;

detecting the release of a predetermined number of cookies from the upper level surface conveyor;

upon detection of the predetermined number of cookies being released moving an inverting mans toward engagement with selected ones of the cookies;

inverting the selected ones of the cookies with the inverting means as the selected cookies drop to the lower level surface conveyor; and continuing the movement of the cookies on the lower level surface conveyor in a spaced series toward a subsequent processing station.

2. The method of inverting cookies according to claim 1, wherein the step of inverting selected ones of the cookies comprises retarding the movement of the leading edges of the selected cookies sufficiently to allow the trailing edges of the cookies to move over the leading edges as the cookies drop from the upper level surface conveyor to the lower level surface conveyor.

3. The method of inverting cookies according to claim 2, wherein the step of retarding the movement of the leading edges of the selected cookies comprises moving the leading edge of each cookie rearwardly with respect to the movement of the cookies along the upper level surface conveyor while the trailing edge of the cookie overturns the leading edge.

4. The method of inverting cookies according to claim 3, wherein the step of retarding the movement of the leading edges of the selected cookies comprises engaging the leading edges of the selected cookies with a flip member positioned below the level of the upper level surface conveyor and urging with the flip member the leading edges rearwardly with respect to the direction of movement of the cookies along the upper level surface conveyor.

5. The method of inverting cookies according to claim 4, wherein the step of inverting the selected ones of the cookies comprises moving the flip member in timed relationship with the movement of the selected ones of the cookies from the upper level surface conveyor to the lower level surface conveyor.

6. The method of inverting cookies according to claim 5, wherein the step of moving the flip member in timed relationship with the movement of the selected ones of the cookies comprises detecting the position of the selected ones of the cookies on the upper level surface conveyor and moving the flip member in response to the detection of the selected ones of the cookies.

7. The method of inverting cookies according to claim 5, wherein the step of moving the flip member in timed relationship with the movement of the selected ones of the cookies comprises spacing the cookies along the upper level surface conveyor at predetermined distances and moving the flip member intermittently from beneath the upper level surface conveyor at a predetermined rate so that as the selected ones of the cookies move off of the upper level surface conveyor the flip member moves from beneath the upper level surface conveyor and flips the cookies.

8. The method according to claim 4 wherein the step of engaging the leading edge of the selected cookies comprises:

extending the flip member from beneath the upper level surface conveyor to a position beyond the end of the upper level surface conveyor and above the lower level surface conveyor so that the leading edge of the selected cookies to be inverted engage the flip plate as the selected cookies move off the upper level surface conveyor; and retracting the flip plate rearwardly toward a point beneath the upper level surface conveyor after the leading edge of the selected cookies engage the flip plate so that the trailing edge of the cookies move over the leading edge of the cookies and the upper surface of the cookies land on the lower level surface conveyor.

9. The method of inverting cookies according to claim 4, and further comprising the step of engaging the bottom surface of the selected ones of the cookies with a cookie bottom surface engaging means as the flip member urges the leading edge of the selected ones of the cookies rearwardly to produce a coupling force on the selected ones of the cookies.

10. The method of inverting cookies according to claim 9, wherein the step of retracting the flip plate includes engaging the edge of the selected ones of the cookies with a lip at the edge of the flip plate so that as the selected ones of the cookies move off the upper level surface conveyor the leading edge of the selected ones of the cookies engage the lip and the cookies turns over.

11. A method of packaging cookies in an edge-standing, horizontally extending relationship to form a slug of cookies with the top surface of the endmost cookie of the slug facing away from the slug, the method comprising the steps of:

moving a series of cookies in an as-baked attitude along a processing path toward a packaging station;

detecting the movement of a predetermined quantity of cookies, which will form the slug of cookies, from an upper level surface conveyor to a main surface conveyor for delivery to a packaging receptacle;

upon detecting the movement of the predetermined number of cookies, engaging at least one selected cookie as the selected cookie moves from the upper level surface conveyor to the main surface conveyor to invert the selected cookie so that the selected cookie moves in an inverted attitude along the processing path; and reorienting the cookies into an edge-standing attitude to form a slug of edge-standing cookies with a previously inverted cookie positioned at the end of the slug of cookies.

12. The method of packaging cookies according to claim 11 wherein the step of moving the cookies comprises:

moving the cookies in a spaced series on an upper level surface conveyor;

dropping the cookies to a lower level surface conveyor; and continuing the movement of the cookies on the lower level surface conveyor to a packaging station.

13. The method of packaging cookies according to claim 11 wherein the step of inverting at least one selected cookie at one end of the slug comprises retarding the movement of the leading edges of the selected cookies sufficiently to allow the trailing edges of the selected cookies to move over the leading edges as the cookies drop from the upper level surface conveyor to the lower level surface conveyor.

14. The method of packaging cookies according to claim 13, wherein the step of retarding the movement of the leading edges of the selected cookies comprises:

extending a flip plate from beneath the upper level surface conveyor and above the lower level surface conveyor to a position where the leading edges of the selected cookies to be inverted engage the flip plate as the selected cookies move off the upper level surface conveyor;

retracting the flip plate back toward a position beneath the upper level surface conveyor after the leading edges of the cookies engage the flip plate so that the trailing edges of the cookies move over the leading edges and the cookies flip and land on the lower level surface conveyor in an inverted attitude.

15. The method of packaging cookies according to claim 14, wherein the step of extending a flip plate comprises detecting the passage of the selected cookies past a sensor means along the upper level surface conveyor and extending the flip plate in response to the detection of the selected cookies.

16. The method of packaging cookies according to claim 14, wherein the step of extending a flip plate comprises spacing the cookies at predetermined distances along the upper level surface conveyor and intermittently extending the flip plate at a predetermined rate so that as the selected cookies move off of the upper level surface conveyor, the flip plate is extended and engages the selected cookies and flips them.

17. The method of packaging cookies according to claim 14, and further comprising the step of engaging the bottom surface of the selected cookies with a cookie bottom surface engaging means while retracting the flip plate to produce a coupling force on the selected cookies.

18. An apparatus for overturning cookies or the like comprising:

an upper level surface conveyor for moving the cookies in an as-baked attitude in a spaced series along a processing path and dropping each cookie in sequence off the end of the lower level surface conveyor;

a lower level surface conveyor positioned below said upper level surface conveyor at a distance for receiving cookies dropped from said upper level surface conveyor so that a cookie reaching the end of said upper level surface conveyor will drop onto said lower level surface conveyor and remain in an as-baked attitude on said lower level surface conveyor;

means for detecting the movement of a predetermined number of cookies, forming a slug of cookies, from said upper level surface conveyor to said lower level surface conveyor; and inverter means movable in response to the movement of selected cookies of the slug of cookies from the upper level surface conveyor to said lower level surface conveyor including means for engaging a leading edge of the selected cookies and retarding the further movement of the selected cookies while a trailing edge of the selected cookies overturns the leading edge to invert the selected cookies of the slug of cookies as the selected cookies move from the upper level surface conveyor to the lower level surface conveyor.

19. The apparatus for overturning cookies as defined in claim 18, wherein said lower level surface conveyor and said upper level surface conveyor move the cookies substantially in the same direction.

20. The apparatus for overturning cookies as defined in claim 18, wherein the distance between said upper level surface conveyor and said lower level surface conveyor is approximately one-half the diameter of the cookie to be overturned.

21. The apparatus for overturning cookies as defined in claim 18, wherein said invertor means includes means for inverting the selected cookies as the cookies drop from said upper level surface conveyor to said lower level surface conveyor.

22. The apparatus for overturning cookies as defined in claim 21, wherein said retarding means comprises:

a flip member, means for extending the flip member from beneath said upper level surface conveyor and above said lower level surface conveyor to a position where the leading edges of the selected cookies engage said flip plate as the cookies move off said upper level surface conveyor;

means for retracting said flip plate rearwardly toward a point below said upper level surface conveyor after the leading edges of the selected cookies engage said flip plate so that the trailing edges of the cookies move over the leading edges and the top surfaces of the cookies land on said lower level surface conveyor.

23. The apparatus for overturning cookies as defined in claim 22, wherein said means for extending the flip plate includes sensor means for detecting the selected cookies along the upper level surface conveyor and wherein said means for extending the flip plate is adapted to extend the flip plate in response to the detection of the selected cookies.

24. The apparatus for overturning cookies as defined in claim 22, wherein said means for extending the flip plate includes cookie spacer means for spacing the cookies along the upper level surface conveyor at a predetermined distance and wherein said means for extending the flip plate is adapted to extend the flip plate intermittently at a predetermined rate so that as the selected cookies move off of the upper level surface conveyor, the flip plate is extended and engages the leading edges of the selected cookies.

25. An apparatus for packaging cookies in an edge-standing, horizontally extending slug of cookies with the top surface of the endmost cookies of the slug facing away from the slug, comprising:

conveyor means for moving a predetermined number of cookies, which will form the slug of cookies, in an as-baked attitude in a series along a processing path toward a packaging station;

inverter means for inverting at least one selected cookie at one end of the series of cookies so that the inverted cookie moves in an inverted attitude along the processing path;

said inverter means comprising a flip plate adapted to move in timed relation with the movement of the selected cookie on the conveyor means into a position whereat a leading edge of the selected cookie to be inverted engages said flip plate such that further movement of the leading edge of the cookie in the direction of the processing path is retarded while the trailing edge of the cookie continues to move along the processing path and overturns the leading edge; and means for reorienting the cookies into an edge-standing attitude to form a slug of edge-standing cookies for packaging.

26. The apparatus for packaging cookies as defined in claim 25, wherein said conveyor means comprises:

an upper level surface conveyer; and a lower level surface conveyor positioned below said upper level surface conveyor for receiving cookies from said upper level surface conveyor so that a cookie reaching the end of said upper level surface conveyor drops onto said lower level surface conveyor and remains in an as-baked attitude relative to the surface of each conveyor.

27. The apparatus for packaging cookies as defined in claim 26, wherein said lower level surface conveyor and said upper level surface conveyor are adapted to move the cookies substantially in the same direction.

28. The apparatus for packaging cookies as defined in claim 26, wherein the vertical distance between the end of the conveying surface of said upper level surface conveyor and the conveying surface of said lower level surface conveyor is approximately one-half the diameter of the cookie being turned.

29. The apparatus for packing cookies as defined in claim 26, wherein said inverter means further comprises:

means for extending the flip plate from beneath said upper level surface conveyor and above said lower level surface conveyor to a position where the leading edge of the cookie to be inverted engages said flip plate as the cookie moves off said upper level surface conveyor; and means for retracting said flip plate rearwardly toward a position beneath said upper level surface conveyor after the leading edge of the cookie engages said flip plate so that the trailing edge of the cookie moves over the leading edge and the upper surface of the cookie lands on said lower level surface conveyor.

* * * * *